US009113260B2

(12) United States Patent
Norris

(10) Patent No.: US 9,113,260 B2
(45) Date of Patent: Aug. 18, 2015

(54) PARAMETRIC TRANSDUCER INCLUDING VISUAL INDICIA AND RELATED METHODS

(71) Applicant: Turtle Beach Corporation, Poway, CA (US)

(72) Inventor: Elwood Grant Norris, Poway, CA (US)

(73) Assignee: Turtle Beach Corporation, San Diego, CA (US)

( * ) Notice: Subject to any disclaimer, the term of this patent is extended or adjusted under 35 U.S.C. 154(b) by 0 days.

(21) Appl. No.: 14/337,431

(22) Filed: Jul. 22, 2014

(65) Prior Publication Data

US 2015/0110333 A1 Apr. 23, 2015

Related U.S. Application Data

(60) Provisional application No. 61/893,607, filed on Oct. 21, 2013.

(51) Int. Cl.

| | |
|---|---|
| ***H04R 1/32*** | (2006.01) |
| ***H04R 19/02*** | (2006.01) |
| ***B06B 1/02*** | (2006.01) |
| *H04R 17/10* | (2006.01) |
| *G10K 11/26* | (2006.01) |
| *G10K 15/02* | (2006.01) |

(52) U.S. Cl.

CPC ..... *H04R 1/32* (2013.01); *B06B 1/0276* (2013.01); *H04R 19/02* (2013.01); *B06B 1/0292* (2013.01); *B06B 2201/51* (2013.01); *G10K 11/26* (2013.01); *G10K 15/02* (2013.01); *H04R 17/10* (2013.01); *H04R 2217/03* (2013.01)

(58) Field of Classification Search

CPC B06B 1/0292; B06B 1/0276; B06B 2201/51; H01L 41/09; H01L 41/0973; H04R 2217/03; H04R 1/32; H04R 17/10; H04R 19/02

USPC ..... 381/394, 152, 384, 399, 423, 431, 77, 381/79, 387; 367/138, 139; 340/944, 691.1, 340/691.6, 692

See application file for complete search history.

(56) References Cited

U.S. PATENT DOCUMENTS

| | | | | |
|---|---|---|---|---|
| 5,885,129 | A * | 3/1999 | Norris | 446/405 |
| 2007/0154036 | A1 | 7/2007 | Matsuzawa | |
| 2007/0172076 | A1* | 7/2007 | Mori et al. | 381/77 |
| 2008/0013761 | A1* | 1/2008 | Matsuzawa et al. | 381/191 |
| 2008/0212033 | A1* | 9/2008 | Fukui et al. | 353/15 |
| 2013/0315034 | A1* | 11/2013 | Yagihashi et al. | 367/103 |

FOREIGN PATENT DOCUMENTS

| | | |
|---|---|---|
| WO | 2010061060 | 6/2010 |

OTHER PUBLICATIONS

International Search Report and the Written Opinion for International App. No. PCT/US2014/060158, mailed Mar. 2, 2015.

* cited by examiner

*Primary Examiner* — Jesse Elbin

(74) *Attorney, Agent, or Firm* — Sheppard Mullin Richter & Hampton LLP

(57) ABSTRACT

A visual indicator is incorporated into an ultrasonic emitter/sound system for ultrasonic carrier audio applications. The visual indicator can be utilized to ensure that an orientation of the ultrasonic emitter is appropriate relative to a position of an intended target of the audio modulated ultrasonic carrier signal, or that a listener is appropriately located relative to the ultrasonic emitter such that it can receive a targeted audio transmission.

19 Claims, 12 Drawing Sheets

PARAMETRIC TRANSDUCER INCLUDING VISUAL INDICIA AND RELATED METHODS

CROSS-REFERENCE TO RELATED APPLICATIONS

This application is a continuation of and claims the benefit of U.S. Provisional Patent Application Ser. No. 61/893,607, titled Ultrasonic Emitter System with a Visual Indicator to Aid Positioning, filed Oct. 21, 2013, which is hereby incorporated herein by reference in its entirety.

TECHNICAL FIELD

The present disclosure relates generally to parametric speakers for a variety of applications. More particularly, some embodiments relate to an ultrasonic emitter.

BACKGROUND OF THE INVENTION

Non-linear transduction results from the introduction of sufficiently intense, audio-modulated ultrasonic signals into an air column. Self-demodulation, or down-conversion, occurs along the air column resulting in the production of an audible acoustic signal. This process occurs because of the known physical principle that when two sound waves with different frequencies are radiated simultaneously in the same medium, a modulated waveform including the sum and difference of the two frequencies is produced by the non-linear (parametric) interaction of the two sound waves. When the two original sound waves are ultrasonic waves and the difference between them is selected to be an audio frequency, an audible sound can be generated by the parametric interaction.

Parametric audio reproduction systems produce sound through the heterodyning of two acoustic signals in a non-linear process that occurs in a medium such as air. The acoustic signals are typically in the ultrasound frequency range. The non-linearity of the medium results in acoustic signals produced by the medium that are the sum and difference of the acoustic signals. Thus, two ultrasound signals that are separated in frequency can result in a difference tone that is within the 60 Hz to 20,000 Hz range of human hearing.

SUMMARY

Embodiments of the technology described herein include an ultrasonic emitter and visual indicator. The visual indicator can be utilized as an alignment tool to ensure that an intended receiver is optimally located relative to the ultrasonic emitter such that the intended receiver is in the path of audio transmitted from the ultrasonic emitter.

In accordance with one embodiment, an ultrasonic audio speaker comprises a backing plate and a flexible layer disposed adjacent the backing plate. The backing plate and the flexible layer are each configured to be electrically coupled to a respective one of a pair of signal lines carrying an audio modulated ultrasonic carrier, wherein upon application of the audio modulated ultrasonic carrier, the flexible layer is configured to launch a pressure-wave representation of the audio modulated ultrasonic carrier signal into the air. Furthermore, the ultrasonic audio speaker comprises a visual indicator configured to provide visual feedback indicative of a position of an intended target of the audio modulated ultrasonic carrier signal relative to the ultrasonic audio speaker.

In accordance with another embodiment, an electrostatic emitter comprises a first pole comprising a conductive element having a textured surface and a second pole comprising a metalized film disposed adjacent the textured surface of the first pole. Upon application of an audio-modulated ultrasonic carrier, the second pole is configured to resonate in response to an audio-modulated signal and to launch a pressure-wave representation of the audio modulated ultrasonic carrier signal into the air. Furthermore, the electrostatic emitter comprises a visual indicator configured to provide visual feedback indicative of an orientation of the ultrasonic audio speaker relative to a position of an intended target of the audio modulated ultrasonic carrier signal. Stated another way, the visual indicator can provide feedback indicative of a position of an intended target of the audio modulated ultrasonic carrier signal relative to the electrostatic emitter.

In accordance with yet another embodiment, an ultrasonic audio speaker comprises a first layer having a first major surface, a second major surface and a conductive region. The ultrasonic audio speaker further includes a second layer disposed adjacent the first layer and that has a first major surface, a second major surface and a conductive region. An insulating region is disposed between the first and second regions, wherein the second layer comprises a backing plate and the backing plate comprises a plurality of textural elements. Additionally, a visual indicator is configured to provide visual feedback indicative of a position of an intended target of the audio modulated ultrasonic carrier signal relative to the ultrasonic audio speaker.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the accompanying figures. The drawings are provided for purposes of illustration only and merely depict typical or example embodiments of the invention. These drawings are provided to facilitate the reader's understanding of the systems and methods described herein, and shall not be considered limiting of the breadth, scope, or applicability of the claimed invention.

Some of the figures included herein illustrate various embodiments of the invention from different viewing angles. Although the accompanying descriptive text may refer to elements depicted therein as being on the "top," "bottom" or "side" of an apparatus, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DESCRIPTION

Embodiments of the systems and methods described herein provide a HyperSonic Sound (HSS) audio system or other ultrasonic audio system for a variety of different applications. Certain embodiments provide a thin film ultrasonic emitter for ultrasonic carrier audio applications.

Figure 1:
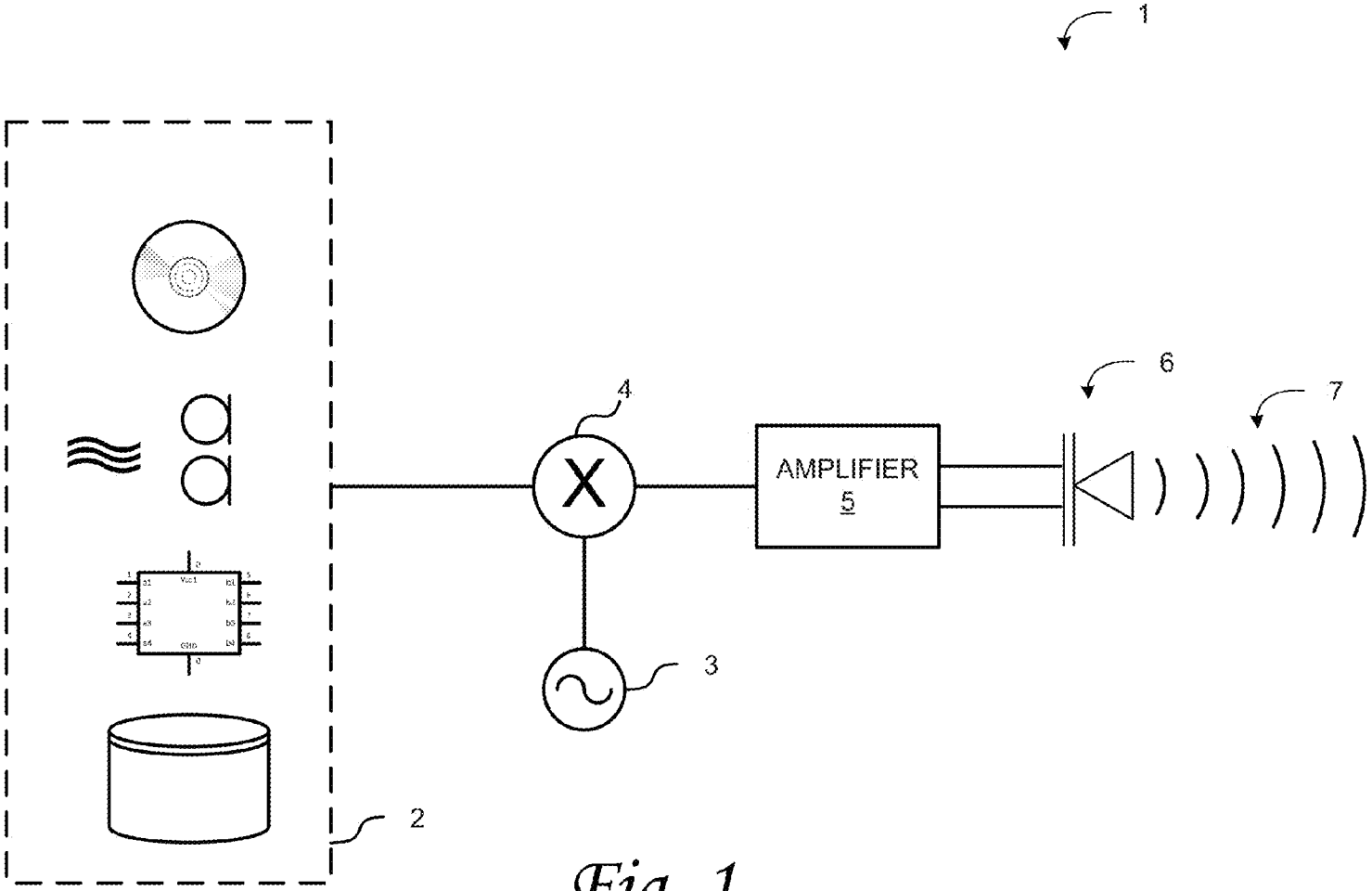
FIG. 1 is a diagram illustrating an ultrasonic sound system suitable for use with the emitter technology described herein.

FIG. 1 is a diagram illustrating an ultrasonic sound system suitable for use in conjunction with the systems and methods described herein. In this exemplary ultrasonic system 1, audio content from an audio source 2, such as, for example, a microphone, memory, a data storage device, streaming media source, MP3, CD, DVD, set-top-box, or other audio source is received. The audio content may be decoded and converted from digital to analog form, depending on the source. The audio content received by the audio system 1 is modulated onto an ultrasonic carrier of frequency f1, using a modulator. The modulator typically includes a local oscillator 3 to generate the ultrasonic carrier signal, and multiplier 4 to modulate the audio signal on the carrier signal. The resultant signal is a double- or single-sideband signal with a carrier at frequency f1 and one or more side lobes. In some embodiments, the signal is a parametric ultrasonic wave or a HSS signal. In most cases, the modulation scheme used is amplitude modulation, or AM, although other modulation schemes can be used as well. Amplitude modulation can be achieved by multiplying the ultrasonic carrier by the information-carrying signal, which in this case is the audio signal. The spectrum of the modulated signal can have two sidebands, an upper and a lower side band, which are symmetric with respect to the carrier frequency, and the carrier itself.

The amplifier 5 provides the modulated ultrasonic signal from the modulator to the transducer 6, which launches the ultrasonic signal into the air creating ultrasonic wave 7. When played back through the transducer at a sufficiently high sound pressure level, due to nonlinear behavior of the air through which it is 'played' or transmitted, the carrier in the signal mixes with the sideband(s) to demodulate the signal and reproduce the audio content. This is sometimes referred to as self-demodulation. Thus, even for single-sideband implementations, the carrier is included with the launched signal so that self-demodulation can take place.

Although the system illustrated in FIG. 1 uses a single transducer to launch a single channel of audio content, one of ordinary skill in the art after reading this description will understand how multiple mixers, amplifiers and transducers can be used to transmit multiple channels of audio using ultrasonic carriers. The ultrasonic transducers can be mounted in any desired location depending on the application.

Figure 2:
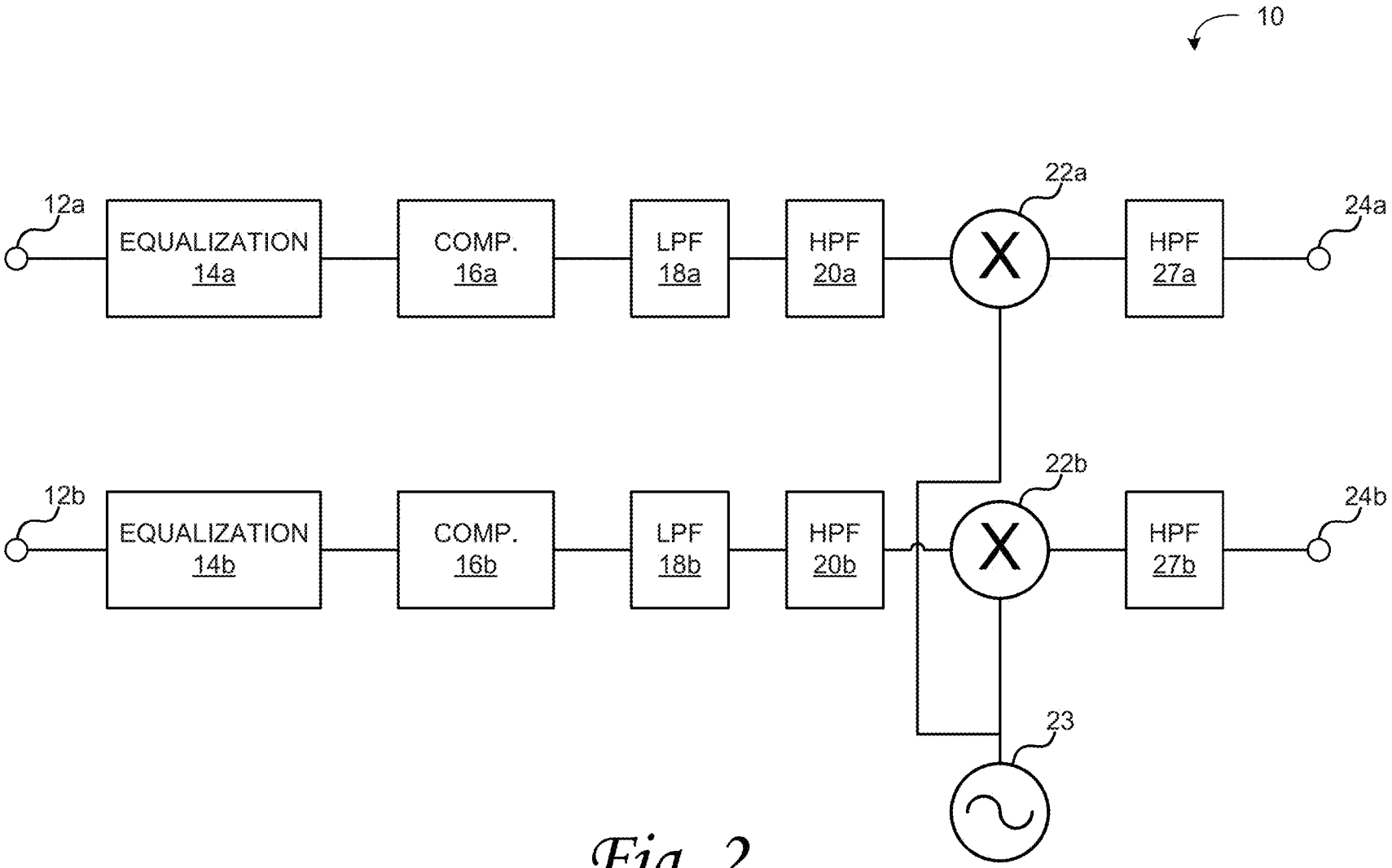
FIG. 2 is a diagram illustrating another example of a signal processing system that is suitable for use with the emitter technology described herein.

One example of a signal processing system 10 that is suitable for use with the technology described herein is illustrated schematically in FIG. 2. In this embodiment, various processing circuits or components are illustrated in the order (relative to the processing path of the signal) in which they are arranged according to one implementation. It is to be understood that the components of the processing circuit can vary, as can the order in which the input signal is processed by each circuit or component. Also, depending upon the embodiment, the processing system 10 can include more or fewer components or circuits than those shown.

Also, the example shown in FIG. 1 is optimized for use in processing two input and output channels (e.g., a "stereo" signal), with various components or circuits including substantially matching components for each channel of the signal. It will be understood by one of ordinary skill in the art after reading this description that the audio system can be implemented using a single channel (e.g., a "monaural" or "mono" signal), two channels (as illustrated in FIG. 2), or a greater number of channels.

Referring now to FIG. 2, the example signal processing system 10 can include audio inputs that can correspond to left 12*a* and right 12*b* channels of an audio input signal. Equalizing networks 14*a*, 14*b* can be included to provide equalization of the signal. The equalization networks can, for example, boost or suppress predetermined frequencies or frequency ranges to increase the benefit provided naturally by the emitter/inductor combination of the parametric emitter assembly.

After the audio signals are equalized, compressor circuits 16*a*, 16*b* can be included to compress the dynamic range of the incoming signal, effectively raising the amplitude of certain portions of the incoming signals and lowering the amplitude of certain other portions of the incoming signals. More particularly, compressor circuits 16*a*, 16*b* can be included to narrow the range of audio amplitudes. In one aspect, the compressors lessen the peak-to-peak amplitude of the input signals by a ratio of not less than about 2:1. Adjusting the input signals to a narrower range of amplitude can be done to minimize distortion, which is characteristic of the limited dynamic range of this class of modulation systems. In other embodiments, the equalizing networks 14*a*, 14*b* can be provided after compressors 16*a*, 16*b*, to equalize the signals after compression.

Low pass filter circuits 18*a*, 18*b* can be included to provide a cutoff of high portions of the signal, and high pass filter circuits 20*a*, 20*b* providing a cutoff of low portions of the audio signals. In one exemplary embodiment, low pass filters 18*a*, 18*b* are used to cut signals higher than about 15-20 kHz, and high pass filters 20*a*, 20*b* are used to cut signals lower than about 20-200 Hz.

The high pass filters 20*a*, 20*b* can be configured to eliminate low frequencies that, after modulation, would result in deviation of carrier frequency (e.g., those portions of the modulated signal of FIG. 6 that are closest to the carrier frequency). Also, some low frequencies are difficult for the system to reproduce efficiently and as a result, much energy can be wasted trying to reproduce these frequencies. Therefore, high pass filters 20*a*, 20*b* can be configured to cut out these frequencies.

The low pass filters 18*a*, 18*b* can be configured to eliminate higher frequencies that, after modulation, could result in the creation of an audible beat signal with the carrier. By way of example, if a low pass filter cuts frequencies above 15 kHz, and the carrier frequency is approximately 44 kHz, the difference signal will not be lower than around 29 kHz, which is still outside of the audible range for humans. However, if frequencies as high as 25 kHz were allowed to pass the filter circuit, the difference signal generated could be in the range of 19 kHz, which is within the range of human hearing.

In the example system 10, after passing through the low pass and high pass filters, the audio signals are modulated by modulators 22*a*, 22*b*. Modulators 22*a*, 22*b*, mix or combine the audio signals with a carrier signal generated by oscillator 23. For example, in some embodiments a single oscillator (which in one embodiment is driven at a selected frequency of 40 kHz to 50 kHz, which range corresponds to readily available crystals that can be used in the oscillator) is used to drive both modulators 22*a*, 22*b*. By utilizing a single oscillator for multiple modulators, an identical carrier frequency is provided to multiple channels being output at 24*a*, 24*b* from the modulators. Using the same carrier frequency for each channel lessens the risk that any audible beat frequencies may occur.

High-pass filters 27*a*, 27*b* can also be included after the modulation stage. High-pass filters 27*a*, 27*b* can be used to pass the modulated ultrasonic carrier signal and ensure that no audio frequencies enter the amplifier via outputs 24*a*, 24*b*. Accordingly, in some embodiments, high-pass filters 27*a*, 27*b* can be configured to filter out signals below about 25 kHz.

Figure 3:
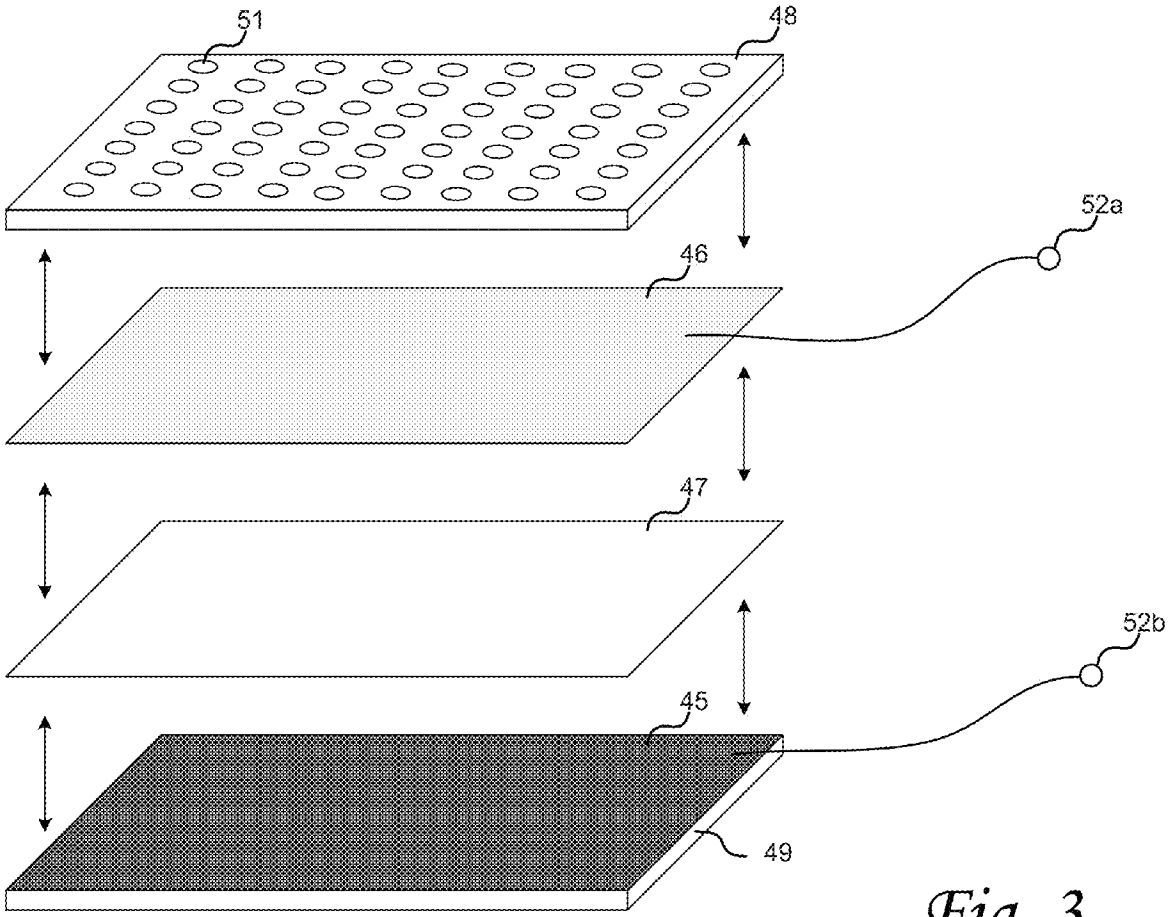
FIG. 3 is a blow-up diagram illustrating an example emitter in accordance with one embodiment of the technology described herein.

FIG. 3 is a blow-up diagram illustrating an example emitter in accordance with one embodiment of the technology described herein. The example emitter shown in FIG. 3 includes one conductive surface 45, another conductive surface 46, an insulating layer 47 and a grating 48. In the illustrated example, conductive layer 45 is disposed on a backing plate 49. In various embodiments, backing plate 49 is a non-conductive backing plate and serves to insulate conductive surface 45 on the back side. For example, conductive surface 45 and backing plate 49 can be implemented as a metalized layer deposited on a non-conductive, or relatively low conductivity, substrate.

As a further example, conductive surface 45 and backing plate 49 can be implemented as a printed circuit board (or other like material) with a metalized layer deposited thereon. As another example, conductive surface 45 can be laminated or sputtered onto backing plate 49, or applied to backing plate 49 using various deposition techniques, including vapor or evaporative deposition, and thermal spray, to name a few. As yet another example, conductive layer 45 can be a metalized film.

Conductive surface 45 can be a continuous surface or it can have slots, holes, cut-outs of various shapes, or other non-conductive areas. Additionally, conductive surface 45 can be a smooth or substantially smooth surface, or it can be rough or pitted. For example, conductive surface 45 can be embossed, stamped, sanded, sand blasted, formed with pits or irregularities in the surface, deposited with a desired degree of 'orange peel' or otherwise provided with texture.

Conductive surface 45 need not be disposed on a dedicated backing plate 49. Instead, in some embodiments, conductive surface 45 can be deposited onto a member that provides another function, such as a member that is part of a speaker housing. Conductive surface 45 can also be deposited directly onto a wall or other location where the emitter is to be mounted, and so on.

Conductive surface 46 provides another pole of the emitter. Conductive surface can be implemented as a metalized film, wherein a metalized layer is deposited onto a film substrate (not separately illustrated). The substrate can be, for example, polypropylene, polyimide, polyethylene terephthalate (PET), biaxially-oriented polyethylene terephthalate (e.g., Mylar, Melinex or Hostaphan), Kapton, or other substrate. In some embodiments, the substrate has low conductivity and, when positioned so that the substrate is between the conductive surfaces of layers 45 and 46, acts as an insulator between conductive surface 45 and conductive surface 46. In other embodiments, there is no non-conductive substrate, and conductive surface 46 is a sheet of conductive material. Graphene or other like conductive materials can be used for conductive surface 46, whether with or without a substrate.

In addition, in some embodiments conductive surface 46 (and its insulating substrate where included) is separated from conductive surface 45 by an insulating layer 47. Insulating layer 47 can be made, for example, using PET, axially or biaxially-oriented polyethylene terephthalate, polypropylene, polyimide, or other insulative film or material.

To drive the emitter with enough power to get sufficient ultrasonic pressure level, arcing can occur where the spacing between conductive surface 46 and conductive surface 45 is too thin. However, where the spacing is too thick, the emitter will not achieve resonance. In one embodiment, insulating layer 47 is a layer of about 0.92 mil in thickness. In some embodiments, insulating layer 47 is a layer from about 0.90 to about 1 mil in thickness. In further embodiments, insulating layer 47 is a layer from about 0.75 to about 1.2 mil in thickness. In still further embodiments, insulating layer 47 is as thin as about 0.33 or 0.25 mil in thickness. Other thicknesses can be used, and in some embodiments, a separate insulating layer 47 is not provided. For example, some embodiments rely on an insulating substrate of conductive layer 46 (e.g., as in the case of a metalized film) to provide insulation between conductive surfaces 45 and 46. One benefit of including an insulating layer 47 is that it can allow a greater level of bias voltage to be applied across the first and second conductive surfaces 45, 46 without arcing. When considering the insulative properties of the materials between the two conductive surfaces 45, 46, one should consider the insulative value of layer 47, if included, and the insulative value of the substrate, if any, on which conductive layer 46 is deposited.

A grating 48 can be included on top of the stack. Grating 48 can be made of a conductive or non-conductive material. In some embodiments, grating 48 can be the grating that forms the external speaker grating for the speaker. Because grating 48 is in contact in some embodiments with the conductive surface 46, grating 48 can be made using a non-conductive material to shield users from the bias voltage present on conductive surface 46. Grating 48 can include holes 51, slots or other openings. These openings can be uniform, or they can vary across the area, and they can be thru-openings extending from one surface of grating 48 to the other. Grating 48 can be of various thicknesses. For example, grating 48 can be approximately 60 mils, although other thicknesses can be used.

Electrical contacts 52*a*, 52*b* are used to couple the modulated carrier signal into the emitter. An example of a driver circuit for the emitter is described below.

Figure 4:
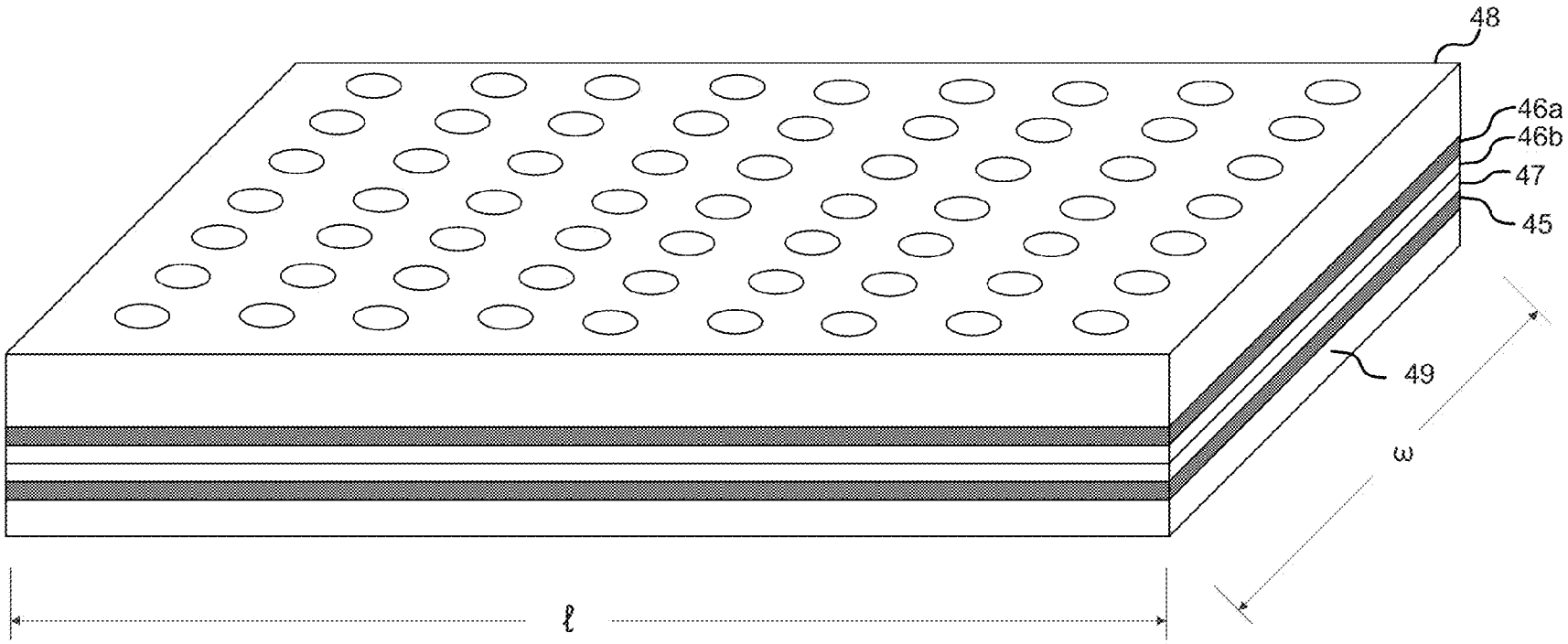
FIG. 4 is a diagram illustrating a cross sectional view of an assembled emitter in accordance with the example illustrated in FIG. 3.

FIG. 4 is a diagram illustrating a cross sectional view of an assembled emitter in accordance with the example illustrated in FIG. 3. As illustrated, this embodiment includes backing plate 49, conductive surface 45, conductive surface 46 (comprising a conductive surface 46*a* deposited on a substrate 46*b*), insulating layer 47 between conductive surface 45 and conductive surface 46*a*, and grating 48. The dimensions in these and other figures, and particularly the thicknesses of the layers, are not drawn to scale.

The emitter can be made to just about any dimension. In one application the emitter is of length, l, 10 inches and its width, w, is 5 inches although other dimensions, both larger and smaller are possible. Practical ranges of length and width can be similar lengths and widths of conventional bookshelf speakers. Greater emitter area can lead to a greater sound output, but may also require higher bias voltages.

Table 1 describes examples of metalized films that can be used to provide conductive surface 46. Low sheet resistance or low ohms/square is preferred for conductive surface 46. Accordingly, films on table 1 having <5 and <1 Ohms/Square exhibited better performance than films with higher Ohms/Square resistance. Films exhibiting 2 k or greater Ohms/Square did not provide high output levels in development testing. Kapton can be a desirable material because it is relatively temperature insensitive in temperature ranges expected for operation of the emitter. Polypropylene may be less desirable due to its relatively low capacitance. A lower capacitance in the emitter means a larger inductance (and hence a physically larger inductor) is needed to form a resonant circuit. As table 1 illustrates, films used to provide conductive surface 46 can range from about 0.25 mil to 3 mils, inclusive of the substrate.

TABLE 1

| Thickness | Material | Ohms/Sq |
|---|---|---|
| 3 mil | Mylar | 2000 |
| .8 mil | Polypropylene | 5 |
| 3 mil | Meta material | 2000+ |
| ¼ mil | Mylar | 2000+ |
| ¼ mil | Mylar | 2000+ |
| ¼ mil | Mylar | 2000+ |
| ¼ mil | Mylar | 2000+ |
| 3 mil | Mylar | 168 |
| .8 mil | Polypropylene | <10 |
| .92 mil | Mylar | 100 |
| 2 mil | Mylar | 160 |
| .8 mil | Polypropylene | 93 |
| 3 mil | Mylar | <1 |
| 1.67 | Polypropylene | 100 |
| .8 mil | Polypropylene | 43 |
| 3 mil | Mylar | <1 |
| 3 mil | Kapton | 49.5 |
| 3 mil | Mylar | <5 |
| 3 mil | Meta material | |
| 3 mil | Mylar | <5 |
| 3 mil | Mylar | <1 |
| 1 mil | Kapton | <1 |
| ¼ mil | Mylar | 5 |
| .92 mil | Mylar | 10 |

Although not shown in table 1, another film that can be used to provide conductive surface 46 is the DE 320 Aluminum/Polyimide film available from the Dunmore Corporation. This film is a polyimide-based product, aluminized on two sides. It is approximately 1 mil in thickness and provides <1 Ohms/Square. As these examples illustrate, any of a number of different metalized films can be provided as conductive surfaces 45, 46. Metalization is typically performed using sputtering or a physical vapor deposition process. Aluminum, nickel, chromium, copper or other conductive materials can be used as the metallic layer, keeping in mind the preference for low Ohms/Square material.

In other embodiments, materials such as graphene can be used as the conductive surfaces. Graphene films can be produced with the desired levels of conductivity (e.g., similar to the films described above), and can, in some cases be made as transparent films. A graphene film can be combined with, or a graphene layer deposited on, an insulating layer (such as, e.g., insulating layer 47) to provide electrical isolation between the conductive layers. Graphene films can be created by a number of techniques. In one example, graphene can be deposited by chemical vapor deposition onto sheets of copper foil (or other sacrificial layer). The graphene can then be coated with a thin layer of adhesive polymer sacrificial layer dissolved away. The graphene can be left on the polymer or pressed against another desired insulating substrate, such as Mylar or Kapton, and the polymer layer removed by heating. The graphene can be treated, for example, with nitric acid, to improve its electrical conductivity.

Metalized or conductive films together with the backing plate typically have a natural resonant frequency at which they will resonate. For some film/backplate combinations, their natural resonant frequency can be in the range of approximately 30-150 kHz. For example, with a backing plate as described above, some 0.33 mil Kapton films resonate at approximately 54 kHz, while some 1.0 mil Kapton films resonate at about 34 kHz. Accordingly, the film/backplate combination and the carrier frequency of the ultrasonic carrier can be chosen such that the carrier frequency matches the resonant frequency of the film/backplate combination. Selecting a carrier frequency at or near the resonant frequency of the film/backplate combination can increase the output of the emitter. For example, the carrier frequency can be selected to be the same or substantially the same as the resonant frequency of the film/backplate combination. In other embodiments, the carrier frequency can be selected to be within 5% or 10% or 15% of the resonant frequency of the film/backplate combination. In other embodiments, the carrier frequency can be selected to be within 20%, 25% or 30% of the resonant frequency of the film/backplate combination. Other frequencies can be selected.

Figure 5:
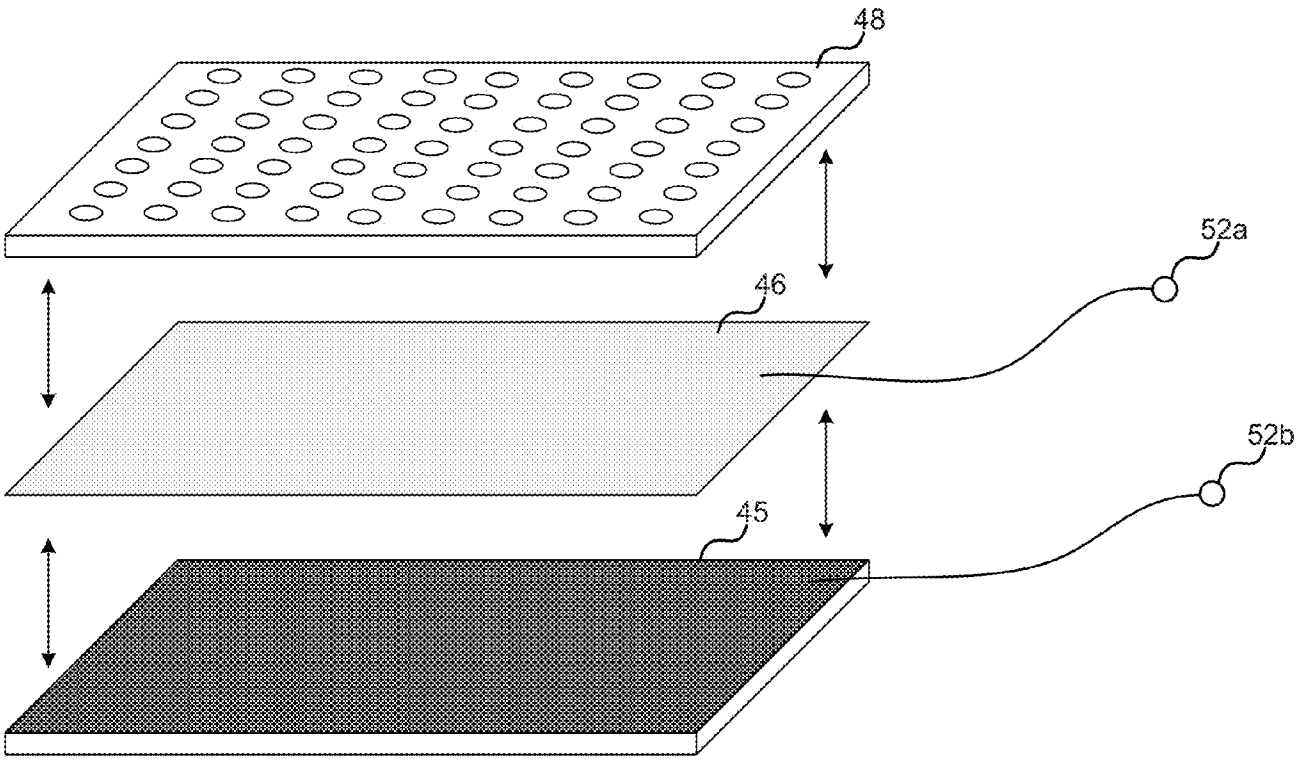
FIG. 5 is a diagram illustrating another example configuration of an ultrasonic emitter in accordance with one embodiment of the technology described herein.

FIG. 5 is a diagram illustrating another example configuration of an ultrasonic emitter in accordance with one embodiment of the technology described herein. The example in FIG. 5 includes conductive surfaces 45 and 46 and grating 48. The difference between the embodiment shown in FIG. 5, and that shown in FIGS. 3 and 4 is that the embodiment shown in FIG. 5 does not include separate insulating layer 47. Layers 45, 46 and 48 can be implemented using the same materials as described above with reference to FIGS. 3 and 4. Particularly, to avoid shorting or arcing between conductive surfaces 45, 46, conductive surface 46 is deposited on a substrate with insulative properties. For example, metalized Mylar or Kapton films like the films shown in Table 1 can be used to implement conductive surface 46, with the film oriented such that the insulating substrate is positioned between conductive surfaces 45, 46.

Figure 6A:
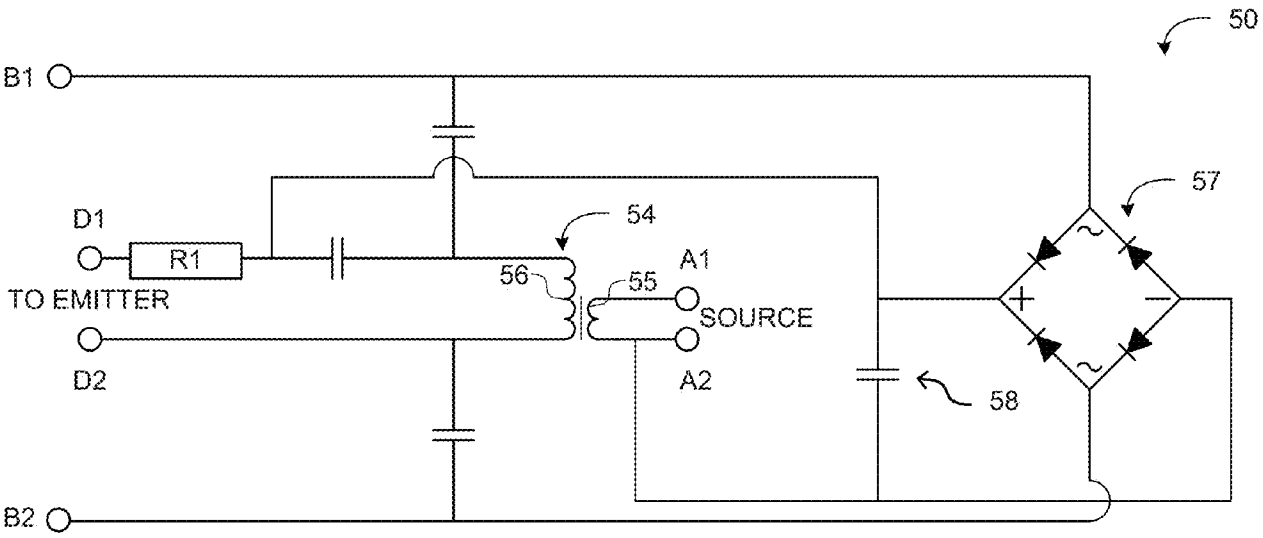
FIG. 6A is a diagram illustrating an example of a simple driver circuit that can be used to drive the emitters disclosed herein.
Figure 6C:
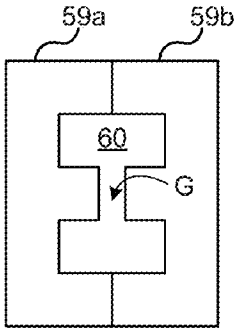
FIG. 6C is a diagram illustrating a cutaway view of an example of a pot core that can be used to form a pot-core inductor.

FIG. 6A is a diagram illustrating an example of a simple driver circuit that can be used to drive the emitters disclosed herein. As would be appreciated by one of ordinary skill in the art, where multiple emitters are used (e.g., for stereo applications), a driver circuit 50 can be provided for each emitter. In some embodiments, the driver circuit 50 is provided in the same housing or assembly as the emitter. In other embodiments, the driver circuit 50 is provided in a separate housing. This driver circuit is only an example, and one of ordinary skill in the art will appreciate that other driver circuits can be used with the emitter technology described herein.

Typically, the modulated signal from the signal processing system 10 is electronically coupled to an amplifier (not shown). The amplifier can be part of, and in the same housing or enclosure as driver circuit 50. Alternatively, the amplifier can be separately housed. After amplification, the signal is delivered to inputs A1, A2 of driver circuit 50. In the embodiments described herein, the emitter assembly includes an emitter that can be operable at ultrasonic frequencies. The emitter (not shown in FIG. 6) is connected to driver circuit 50 at contacts D1, D2. An inductor 54 forms a parallel resonant circuit with the emitter. By configuring the inductor 54 in parallel with the emitter, the current circulates through the inductor and emitter and a parallel resonant circuit can be achieved. Accordingly, the capacitance of the emitter becomes important, because lower capacitance values of the emitter require a larger inductance to achieve resonance at a desired frequency. Accordingly, capacitance values of the layers, and of the emitter as a whole can be an important consideration in emitter design.

A bias voltage is applied across terminals B1, B2 to provide bias to the emitter. Full wave rectifier 57 and filter capacitor 58 provide a DC bias to the circuit across the emitter inputs D1, D2. Ideally, the bias voltage used is approximately twice (or greater) the reverse bias that the emitter is expected to take on. This is to ensure that bias voltage is sufficient to pull the emitter out of a reverse bias state. In one embodiment, the bias voltage is on the order of 300-450 Volts, although voltages in other ranges can be used. For example, 350 Volts can be used. For ultrasonic emitters, bias voltages are typically in the range of a few hundred to several hundred volts.

Although series arrangements can be used, arranging inductor 54 in parallel with the emitter can provide advantages over series arrangement. For example, in this configuration, resonance can be achieved in the inductor-emitter circuit without the direct presence of the amplifier in the current path. This can result in more stable and predictable performance of the emitter, and less power being wasted as compared to series configuration.

Obtaining resonance at optimal system performance can improve the efficiency of the system (that is, reduce the power consumed by the system) and reduce the heat produced by the system.

With a series arrangement, the circuit causes wasted current to flow through the inductor. As is known in the art, the emitter will perform best at (or near) the point where electrical resonance is achieved in the circuit. However, the amplifier introduces changes in the circuit, which can vary by temperature, signal variance, system performance, etc. Thus, it can be more difficult to obtain (and maintain) stable resonance in the circuit when the inductor 54 is oriented in series with the emitter (and the amplifier).

Figure 6B:
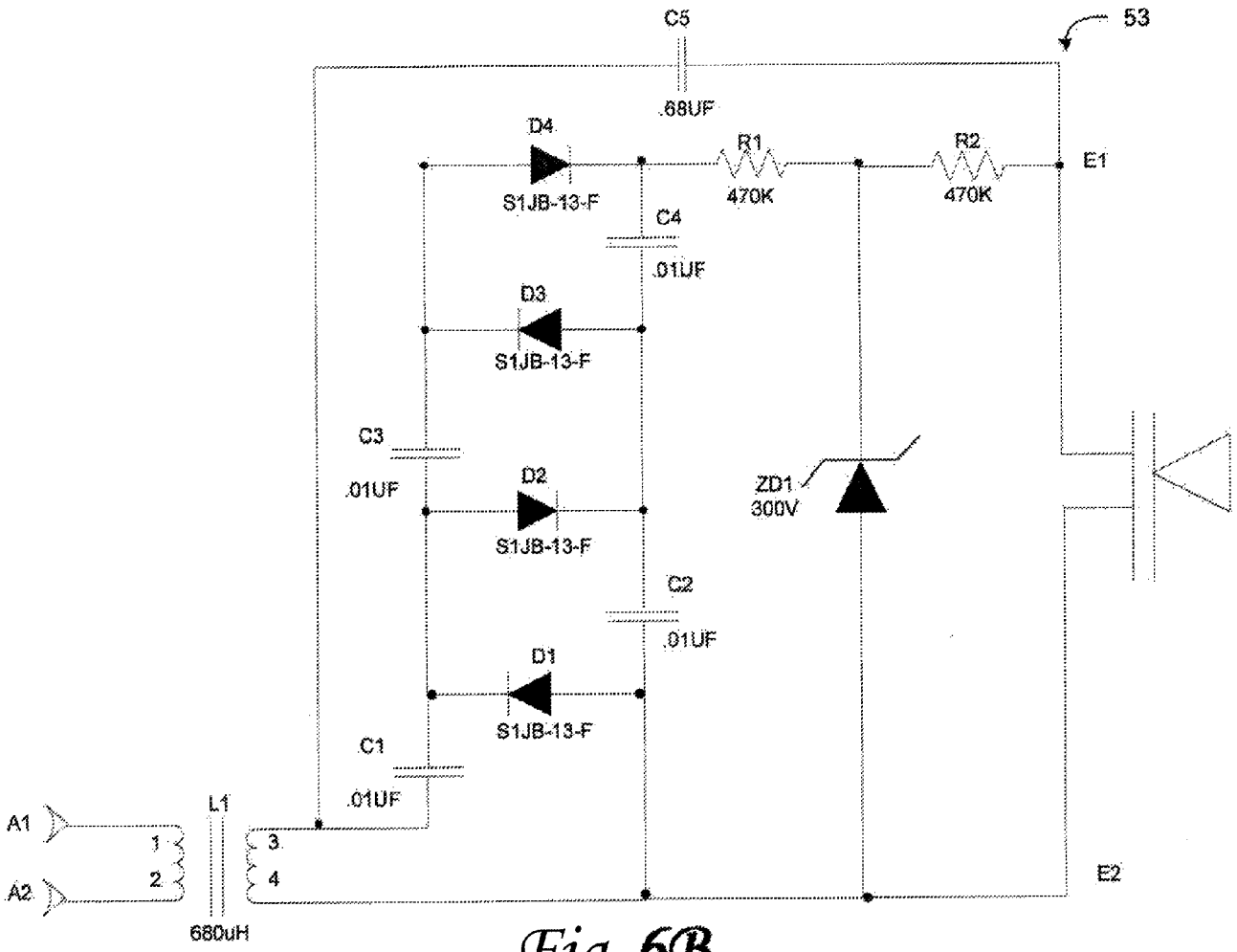
FIG. 6B is a diagram illustrating an example of a simple circuit to generate a bias voltage at the emitter drawing the necessary voltage from the signal itself. In this example, the circuit is designed to bias at 300V but other voltages are possible by changing diode ZD1.

FIG. 6B is a diagram illustrating an example of a simple bias circuit that can be used with the emitters disclosed herein. As would be appreciated by one of ordinary skill in the art, where multiple emitters are used (e.g., for stereo applications), a bias circuit 53 can be provided for each emitter. In some embodiments, the bias circuit 53 is provided in the same housing or assembly as the emitter. In other embodiments, the bias circuit 53 is provided in a separate housing. This driver circuit is only an example, and one of ordinary skill in the art will appreciate that other driver circuits can be used with the emitter technology described herein.

Typically, the modulated signal from the signal processing system 10 is electronically coupled to an amplifier (not shown). The amplifier can be part of, and in the same housing or enclosure as driver circuit 53. Alternatively, the amplifier can be separately housed. After amplification, the signal is delivered to inputs A1, A2 of circuit 53. In the embodiments described herein, the emitter assembly includes an emitter that can be operable at ultrasonic frequencies. The emitter is connected to driver circuit 53 at contacts E1, E2. An advantage of the circuit shown in FIG. 5B is that the bias can be generated from the ultrasonic carrier signal, and a separate bias supply is not required. In operation, diodes D1-D4 in combination with capacitors C1-C4 are are configured to operate as rectifier and voltage multiplier. Particularly, diodes D1-D4 and capacitors C1-C4 are configured as a rectifier and voltage quadrupler resulting in a DC bias voltage of up to approximately four times the carrier voltage amplitude across nodes E1, E2. Other levels of voltage multiplication can be provided using similar, known voltage multiplication techniques.

Capacitor C5 is chosen large enough to hold the bias and present an open circuit to the DC voltage at E1 (i.e., to prevent the DC from shorting to ground), but small enough to allow the modulated ultrasonic carrier pass to the emitter. Resistors R1, R2 form a voltage divider, and in combination with Zener diode ZD1, limit the bias voltage to the desired level, which in the illustrated example is 300 Volts.

Inductor 54 can be of a variety of types known to those of ordinary skill in the art. However, inductors generate a magnetic field that can "leak" beyond the confines of the inductor. This field can interfere with the operation and/or response of the emitter. Also, many inductor/emitter pairs used in ultrasonic sound applications operate at voltages that generate large amounts of thermal energy. Heat can also negatively affect the performance of a parametric emitter.

For at least these reasons, in most conventional parametric sound systems the inductor is physically located a considerable distance from the emitter. While this solution addresses the issues outlined above, it adds another complication. The signal carried from the inductor to the emitter is can be a relatively high voltage (on the order of 160 V peak-to-peak or higher). As such, the wiring connecting the inductor to the emitter must be rated for high voltage applications. Also, long runs of the wiring may be necessary in certain installations, which can be both expensive and dangerous, and can also interfere with communication systems not related to the parametric emitter system.

The inductor 54 (including as a component as shown in the configurations of FIGS. 6A and 6B) can be implemented using a pot core inductor. A pot core inductor is housed within a pot core that is typically formed of a ferrite material. This confines the inductor windings and the magnetic field generated by the inductor. Typically, the pot core includes two ferrite halves 59*a*, 59*b* that define a cavity 60 within which the windings of the inductor can be disposed. See FIG. 6C. An air gap G can be included to increase the permeability of the pot core without affecting the shielding capability of the core. Thus, by increasing the size of the air gap G, the permeability of the pot core is increased. However, increasing the air gap G also requires an increase in the number of turns in the inductor(s) held within the pot core in order to achieve a desired amount of inductance. Thus, an air gap can increase permeability and at the same time reduce heat generated by the pot core inductor, without compromising the shielding properties of the core.

In the examples illustrated in FIGS. 6A and 6B, a dual-winding step-up transformer is used. However, the primary 55 and secondary 56 windings can be combined in what is commonly referred to as an autotransformer configuration. Either or both the primary and secondary windings can be contained within the pot core.

As discussed above, it is desirable to achieve a parallel resonant circuit with inductor 54 and the emitter. It is also desirable to match the impedance of the inductor/emitter pair with the impedance expected by the amplifier. This generally requires increasing the impedance of the inductor emitter pair. It may also be desirable to achieve these objectives while locating the inductor physically near the emitter. Therefore, in some embodiments, the air gap of the pot core is selected such that the number of turns in the primary winding 55 present the impedance load expected by the amplifier. In this way, each loop of the circuit can be tuned to operate at an increased efficiency level. Increasing the air gap in the pot core provides the ability to increase the number of turns in inductor element 55 without changing the desired inductance of inductor element 56 (which would otherwise affect the resonance in the emitter loop). This, in turn, provides the ability to adjust the number of turns in inductor element 55 to match the impedance load expected by the amplifier.

An additional benefit of increasing the size of the air gap is that the physical size of the pot core can be reduced. Accordingly, a smaller pot core transformer can be used while still providing the same inductance to create resonance with the emitter.

The use of a step-up transformer provides additional advantages to the present system. Because the transformer "steps-up" from the direction of the amplifier to the emitter, it necessarily "steps-down" from the direction of the emitter to the amplifier. Thus, any negative feedback that might otherwise travel from the inductor/emitter pair to the amplifier is reduced by the step-down process, thus minimizing the effect of any such event on the amplifier and the system in general (in particular, changes in the inductor/emitter pair that might affect the impedance load experienced by the amplifier are reduced).

In one embodiment, 30/46 enameled Litz wire is used for the primary and secondary windings. Litz wire comprises many thin wire strands, individually insulated and twisted or woven together. Litz wire uses a plurality of thin, individually insulated conductors in parallel. The diameter of the individual conductors is chosen to be less than a skin-depth at the operating frequency, so that the strands do not suffer an appreciable skin effect loss. Accordingly, Litz wire can allow better performance at higher frequencies.

A bias voltage is applied across terminals B1, B2 to provide bias to the emitter. Full wave rectifier 57 and filter capacitor 58 provide a DC bias to the circuit across the emitter inputs D1, D2. Ideally, the bias voltage used is approximately twice (or greater) the reverse bias that the emitter is expected to take on. This is to ensure that bias voltage is sufficient to pull the emitter out of a reverse bias state. In one embodiment, the bias voltage is on the order of 350-420 Volts. In other embodiments, other bias voltages can be used. For ultrasonic emitters, bias voltages are typically in the range of a few hundred to several hundred volts.

Although not shown in the figures, where the bias voltage is high enough, arcing can occur between conductive layers 45, 46. This arcing can occur through the intermediate insulating layers as well as at the edges of the emitter (around the outer edges of the insulating layers. Accordingly, the insulating layer 47 can be made larger in length and width than conductive surfaces 45, 46, to prevent edge arcing. Likewise, where conductive layer 46 is a metalized film on an insulating substrate, conductive layer 46 can be made larger in length and width than conductive layer 45, to increase the distance from the edges of conductive layer 46 to the edges of conductive layer 45.

Resistor R1 can be included to lower or flatten the Q factor of the resonant circuit. Resistor R1 is not needed in all cases and air as a load will naturally lower the Q. Likewise, thinner Litz wire in inductor 54 can also lower the Q so the peak isn't overly sharp.

As described herein, various embodiments can be configured to transmit one or more channels of audio using ultrasonic carriers. The transmission of audio using ultrasonic carriers can be used in a variety of different scenarios/contexts as will be described in greater detail below. For example, various embodiments may be utilized in or for implementing directed/targeted or isolated sound systems, specialized audio effects, hearing amplifiers/aids, as well as sound alteration.

Targeted or isolated sound systems can refer to systems that direct audio to a particular target. That is, an aforementioned HSS audio sound system can be utilized to create a "zone" of audio using an ultrasonic carrier that is highly directional. Accordingly, an audio signal modulated on an ultrasonic carrier signal can be directed to a specific target or area, where the demodulated audio signal cannot be heard outside of the intended zone of audio.

Accordingly, such targeted or isolated sound systems lend themselves to a myriad of applications. One such application may be warning or alert systems. In an emergency situation, emergency vehicles, such as police cars, ambulances, fire engines, etc., often must navigate through and around road traffic. Traditionally, such emergency vehicles notify drivers to move out of their path via loud, flashing sirens. This can create noise pollution for surrounding areas, create confusion for drivers that cannot determine whether or not they must pull to the side of a road, etc. Thus, such emergency vehicles may utilize various embodiments to direct warnings or alerts to particular vehicles in traffic or specific areas to direct the drivers of such vehicles accordingly. It should be noted that the range of a propagated ultrasonic carrier signal can be varied based on the particular ultrasonic emitter and/or ultrasonic carrier signal frequency that is utilized for transmission. Longer or shorter range transmission can be used as appropriate.

Another application may be for directing the visually impaired at crosswalks. For example, an ultrasonic sound system can be activated by a visually impaired person at a crosswalk, and the ultrasonic sound system can be used to relay instructions to the visually impaired person as he/she walks across a road or any other path where he/she might require assistance. As long as the visually impaired person can hear the directed audio instructions, he/she can be ensured that they are following the correct path and/or at the correct time to avoid an accident.

Still other applications can involve the dispersion of crowds, nuisance animals, and the like. For example, airports currently rely on auditory scarers to attempt to scare birds away from the flight path of airplanes. Current auditory scarers rely on loud explosions using, e.g., propane cannons, but such technologies can be an annoyance to people and surrounding areas. Other conventional auditory scarers rely on ultrasound emitting devices, but the usefulness of such devices is debatable as birds may not be able to hear on the ultrasonic level. For crowd dispersion, the use of megaphones, public address (PA) systems can often cause more distress and confusion rather than diffuse a situation and effectuate control. Therefore, various embodiments can be utilized to again, direct audio modulated on an ultrasonic carrier to target specific areas, such as airports, the roofs of buildings, people, animals, etc. without the negative repercussions of conventional technologies.

Other contexts in which isolated sounds systems have value is in confined areas, such as hotel rooms, bedrooms, automobiles, and the like. For example, various embodiments may be utilized to direct audio to an intended receiver or target while excluding unintended receivers from hearing the audio in the same space. Accordingly, an ultrasonic emitter can be implemented as part of one or more sources of audio, such as television, stereo system, etc. for directing audio to an intended listener in a bedroom so that another, e.g., sleeping, person in the bedroom need not be disturbed. Alarm clocks may also incorporate the technologies described herein to direct audible alarms to only an intended party. In vehicles, ultrasonic emitters can be utilized to direct audio signals to particular passengers or areas of the vehicle. For example, directions from a navigation system can be directed solely to a driver of the vehicle, leaving other passengers undisturbed. Additionally, passengers in a vehicle can enjoy separate entertainment media without the need for headphones to isolate themselves. Further expanding on the utility of various embodiments, described herein, conferences or other speaking engagements that may require the translation of speech into different languages can utilize ultrasonic emitters that transmit directed audio in different languages to the appropriate attendees.

Areas where discretion or quiet is preferable can take advantage of various embodiments as well. For example, churches, museums, libraries, theaters, performance venues, etc., can provide auditory signals for various purposes without fear of disturbing the environment. Such areas may also require limited signage or have limited visibility, such as a darkened movie theater or opera venue. Accordingly, ultrasound emitters can be utilized to discreetly direct patrons to seating, for example. Further still, actors, directors, and/or other types of performers can also take advantage of various embodiments described herein, where verbal cues, instructions, or other auditory signals or sounds can be directed to an intended target unbeknownst to audience members. In fact, the acoustical properties of such venues may even be improved through the use of the technologies described herein, as conventional issues such as reverberation, echo, interference, and the like can be avoided with directional/targeted audio.

Such isolated sound systems can also be extremely useful in situations where there is heavy noise traffic, such as in areas with multiple media systems/audio sources that conventionally, would interfere with each other, e.g., casinos, hospital wards, airports, sports bars, family rooms, video game arcades, and the like. For example, various embodiments may be used to isolate audio from televisions to patients in hospital beds that may only be separated by a screen, and kiosks, status monitors in airports, or ATMs that provide directions, instructions, generalized information, personalized information to users. Such isolated sounds systems can also be leveraged in personal computing devices, such as tablet PCs, mobile devices, such as cellular phones, smart phones, PDAs, etc. to provide privacy for users and avoid disturbing nearby people. Even devices traditionally aimed at isolating audio such as a headphones, earbuds, and the like can leak audio, and therefore, various embodiments can be utilized to improve the performance of such devices. Moreover, noise cancellation can be accomplished in accordance with various embodiments as well, where Another area where targeted audio can be applied is in advertising and marketing. Targeted audio, whether in the form of advertisements, informational messages, or the like can be directed to specific areas of a retail establishment, shopping center, or to particular patrons/customers. For example, as a customer walks through particular aisles of a grocery store, or as potential customers pass by establishments, advertising messages can be directed to them, i.e., digital signage. Point of sale (POS) devices, such as electronic payment devices, vending machines, and the like can all be enhanced with targeted audio, such as again, advertising, informational/instructional messages, etc. It should be noted that the aforementioned advantages previously described can also act to enhance advertising, such as making it less intrusive, making it more effective by targeting a more appropriate consumer rather than relying on, e.g., general announcements.

Still other uses of the technologies described herein include generating specialized audio effects and altering sound characteristics. For example, an array of ultrasonic emitters configured in accordance with various embodiments may directionally "sweep" one or more audio signals over an audience at a performance venue to provide different sound effects. Likewise, gaming consoles/systems, may utilize various technologies described herein to provide, e.g., a more realistic and/or more immersive sound environment during gameplay by optimally directing audio about a user. The directionality of audio provided by various embodiments can be used to bounce or reflect audio signals to simulate audio sources from various locations without, produce special effects, etc.

Moreover, various technologies described herein can also be applied to hearing aids or other assistive hearing devices. For example, demodulation of an audio-encoded ultrasonic carrier signal can be accomplished within a listener's skull or within the listener's inner ear. In particular, a hearing response profile of a listener to an audio modulated ultrasonic carrier signal can be determined, and audio content can be adjusted to at least partially compensate for the listener's hearing response profile.

Various embodiments may also be utilized to provide auditory feedback to a speaker. For example, voice can be fed back to a speaker's ears using an ultrasonic emitter that varies the audio signal(s) representative of the speaker's voice to cause the speaker to speak more loudly or more quietly.

In accordance with various embodiments, a visual indicator is incorporated into an ultrasonic emitter/sound system for ultrasonic carrier audio applications. The visual indicator can be utilized to ensure that an intended receiver is appropriately located or positioned relative to the ultrasonic emitter (i.e., that the emitter is accurately 'aimed at' the listener or that the listener is positioned in the path of the ultrasonic signal) such that it can receive the targeted audio transmission. Accordingly, various embodiments of the technology described herein can be utilized in the aforementioned scenarios involving, e.g., directed or isolated and targeted audio systems, for example.

Figure 7:
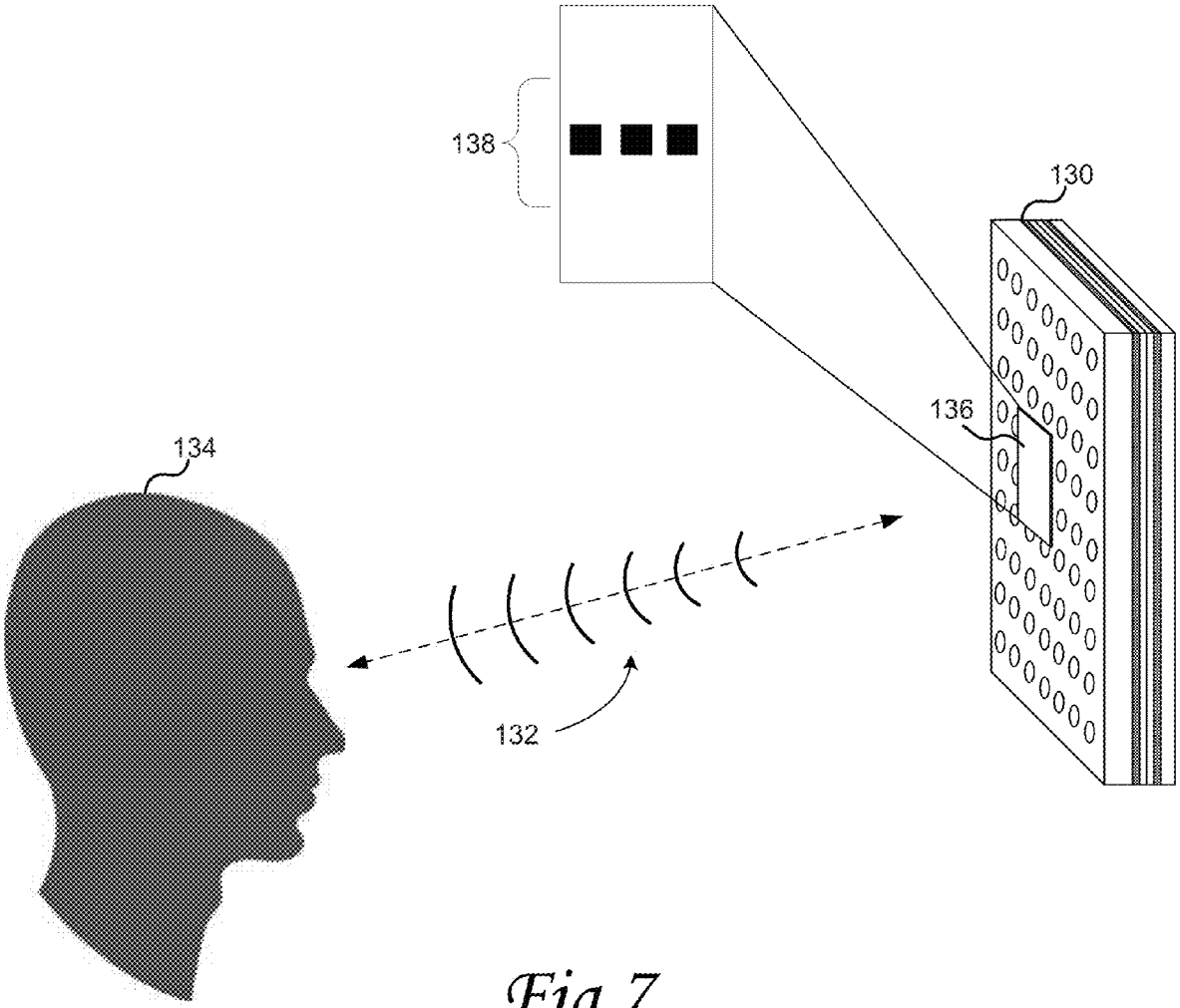
FIG. 7 is a diagram illustrating an example of an emitter in which a visual indicator is incorporated in accordance with one embodiment.

FIG. 7 illustrates an example of targeted audio transmission utilizing a visual indicator in accordance with one embodiment. Illustrated in FIG. 7 is an example ultrasonic emitter 130 in accordance with various embodiments of the technology described herein. Ultrasonic emitter 130 may transmit an audio modulated ultrasonic signal 132 as also described herein, towards an intended target 134. Intended target 134 may be, e.g., a human listener, although as will be described in greater detail below, intended target 134 may be an animal, a vehicle, a particular area, or any like entity or space to which an ultrasonic signal can be directed.

Audio modulated ultrasonic signal 132 projected from ultrasonic emitter 130 is emitted in a "narrow" beam. While transmission of a narrow beam is advantageous for precisely focusing or directing audio to an intended target, it also suggests that the intended target should be in the path of that narrow beam. If the intended target moves or is positioned outside of the path of the narrow beam, the intended target will not hear the transmitted audio.

Accordingly, ultrasonic emitter 130 may utilize or have implemented therein, a visual indicator 136 to achieve appropriate positioning of intended receiver 134 relative to ultrasonic emitter 130. To this end, visual indicator 136 may be some form of sighting or alignment mechanism visible to an intended target 134 in the path of the beam. Thus, positioning of intended target 134 would be achieved by intended target 134 establishing a line of sight with visual indicator 136. Likewise, one implementing a system and installing an emitter intended to direct ultrasonic signal 132 toward a predetermined listening area can use visual indicator 136 to ensure that the emitter is 'aimed' at the listening area, and to make adjustments to its orientation if the emitter is not aimed properly.

In one embodiment, visual indicator 136 may be implemented on the surface or other area of ultrasonic emitter 130. Various mechanisms may be utilized to control the viewing angle associated with visual indicator 136. In some embodiments, a narrow viewing angle can be provided such that the indicator 136 is difficult or impossible to see if the listener is not in the path of ultrasonic signal 132. In this manner, when the emitter is oriented such that the installer sees the indicator 136, he or she knows the emitter is aimed at the intended area. Likewise, when an intended listener sees the indicator 136, the listener knows he or she is in the path of the beam. Another alternative would be to utilize a mirror mounted on or otherwise integrated with ultrasonic emitter 130, such that the listener being able to perceive himself or herself in the mirror(s) would suggest proper positioning relative to ultrasonic emitter 130.

As a further example, visual indicator 136 may be configured such that the appropriate positioning of intended target 134 relative to the emitter 130 would result in intended target 134 being able to visually perceive visual indicator 136 with both left and right eyes. If intended target 134 is only able to view visual indicator 136 with a single eye, for example, if the head of intended target 134 is turned away or otherwise not optimally positioned, intended target 134 will know to reposition him/herself with respect to ultrasonic emitter 130.

In accordance with another example, visual indicator 136 may be some form of visual indicia, such as a set of markings, where the ability to perceive the entire set of markings suggests proper alignment with ultrasonic emitter 136. However, perceiving some subset less than the entire set of markings would suggest non-optimal alignment with ultrasonic emitter 136. For example, visual indicator 136 may include a row of three distinct marks 138. Proper alignment of intended target 134 relative to ultrasonic emitter 130 would result in intended target 134 being able to perceive the entire row of marks 138. Improper alignment of intended target 134 with ultrasonic emitter 130 would result in intended target 134 only being able to perceive, e.g., two out of the three marks 138. The markings, for example, can be disposed on the face of the emitter and arranged relative to one another in a direction normal to the surface of the emitter (or otherwise in line or substantially in line with the direction of the emitted ultrasonic signals). Markings so configured can be a series of two or more elements so arranged.

As yet a further embodiment, lenticular lenses or images can be used to provide a means of determining the orientation of an emitter 130. For example, a lenticular image or an array of lenticular images can be created (or a plurality of images combined with a lenticular lens) and disposed on the emitter 130 at such an angle that the image is visible to the listener when the ultrasonic emitter 130 is pointed toward the listener, and not visible otherwise. Still further, an array of lenticular images can be disposed on the emitter each with an indicator image showing the direction in which the emitter is tilted away from the listener. The lenticular images can be arranged in a removable unit such that they can be affixed to the emitter for positioning and removed once proper positioning is achieved.

Figure 8C:
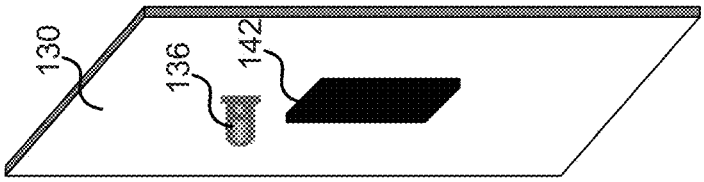
FIGS. 8A-8D are diagrams illustrating example emitter and visual indicator configurations in accordance with various embodiments.
Figure 8B:
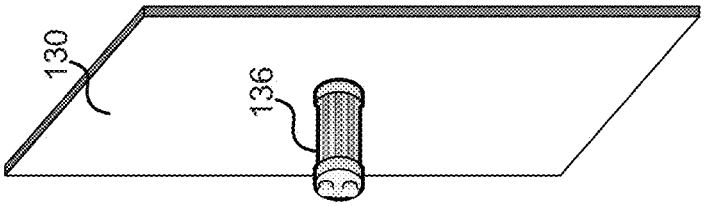
Figure 8A:
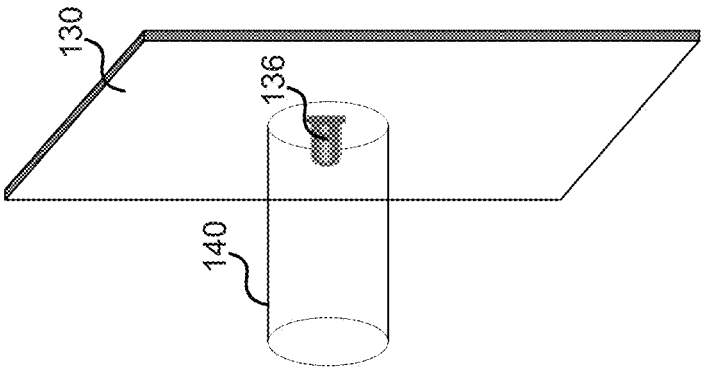

In accordance with still another embodiment, visual indicator 136 may be some form of light source, such as a light emitting diode (LED) as illustrated in FIG. 8A. A concentrator 140 may be used in conjunction with visual indicator 136 to concentrate or focus the light emitted by the LED into a narrow beam. Narrowing the beam of light from the LED would serve to narrow the viewing angle of visual indicator 136. The concentrator can, in some embodiments direct light in a perpendicular or substantially perpendicular direction from the plane of the emitter. The concentrator can rely on total internal reflection, or can have an exterior coating, to avoid or reduce the amount of stray light emanating in unwanted directions. Instead of a tubular concentrator, concentrator 140 may include one or more lenses oriented such that light transmitted from visual indicator 136, e.g., an LED, is concentrated or otherwise narrowed. Alternatively, LED may be a shrouded LED or the LED may be embedded into ultrasonic emitter 130 (ultrasonic emitter 130 acting as the shroud).

Alternatively still, and as illustrated in FIG. 8B, an optical fiber or other light source having similar directional functionality may be utilized to again, focus the beam of light transmitted therefrom to reduce the viewing angle. FIG. 8B illustrates yet another embodiment, where visual indicator 136 may be utilized in conjunction with a sensor 142, such as a proximity sensor (or array of sensors). Sensor 142 can be configured such that when it senses that intended target 134 is optimally or otherwise appropriately positioned relative to ultrasonic emitter 130, visual indicator 136, e.g., an LED, can be triggered to illuminate indicating to intended target 134 that it is appropriately positioned.

Figure 8D:
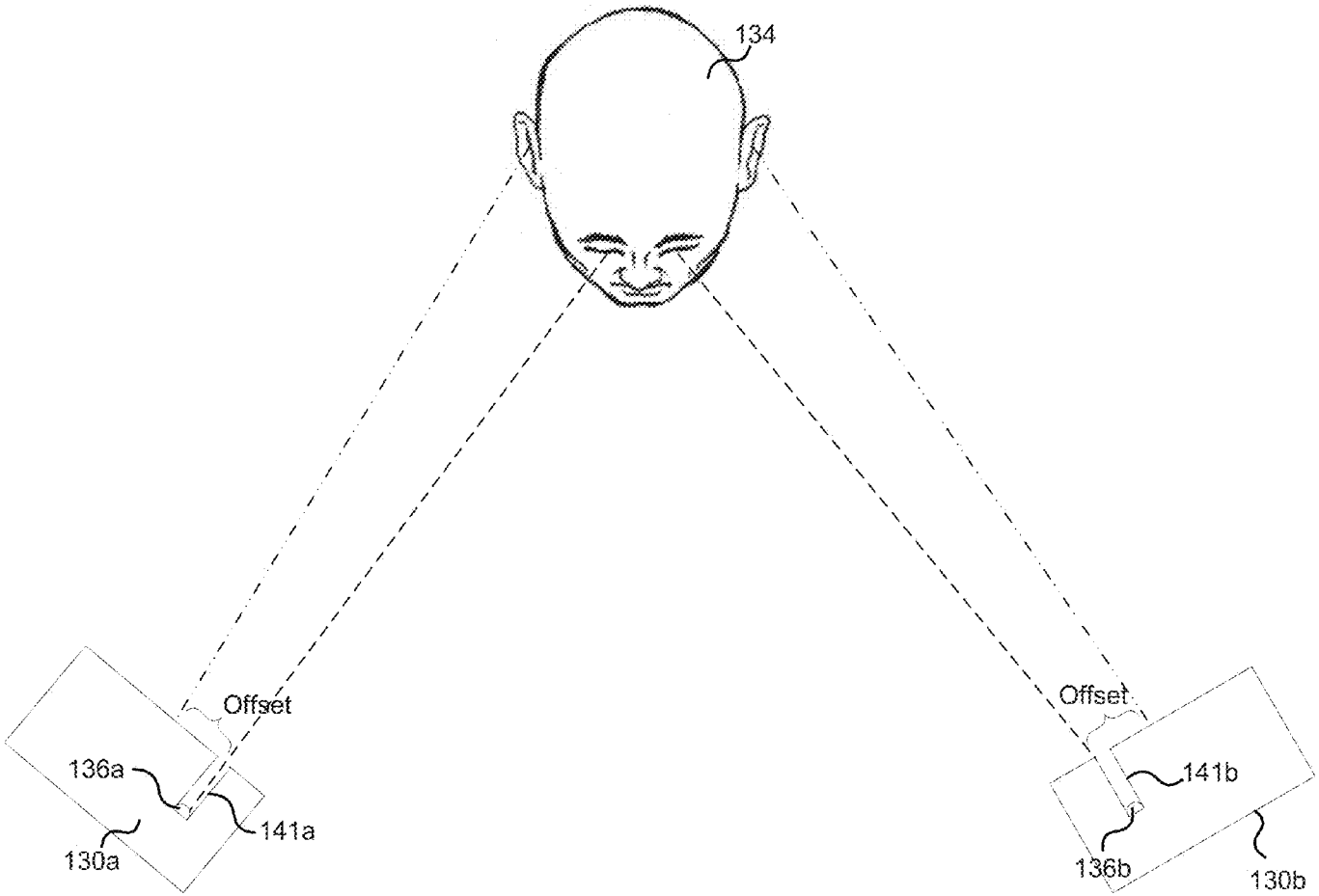

As yet another alternative, a visual indicator can be recessed into the face of an emitter rather than utilizing a concentrator protruding therefrom. Illustrated in FIG. 8D is an example of such a configuration, where two emitters 130*a*, 130*b* each of which have recessed therein, visual indicators 136*a* and 136*b*, respectively. For example, visual indicators 136*a* and 136*b* may be disposed at the base of recesses 141*a* and 141*b*, such as, for example, cylindrical recesses on the face of emitters 130*a* and 130*b*, such that visual indicators 136*a*, 136*b* are not visible to intended target 134 unless emitters 130*a*, 130*b* are properly oriented toward intended target 134. Recesses 141*a*, 141*b* can be configured to be deep enough such that the sidewalls of each of recesses 141*a* and 141*b* obscure visual indicators 136*a* and 136*b*, respectively, unless emitters 130*a*, 130*b* are aimed toward intended target 134. The sidewalls of recesses 141*a* and 141*b* may be constructed of or have an inner coating of a light absorptive paint or material, such that light emitted from visual indicators 136*a* and 136*b* is not reflected or reflections are reduced. This can reduce or prevent light from reflecting off of the sidewalls and interfering with the alignment of the emitter (e.g., avoid unwanted perception of one or both of visual indicators 136*a* and 136*b* when the listener is not properly/optimally positioned).

It should be noted that a set of emitters 130*a* and 130*b* are illustrated for purposes of describing a likely scenario where two emitters are used, although any number of emitters can be configured with any number visual indicators (to achieve a desired accuracy with respect to optimal or preferred emitter positioning relative to an intended target. Moreover, each visual indicator/emitter 'combination' can work together or separately. That is, and as previously described, various embodiments may implement visual indicators that require perception by both of a listener's eyes (right and left). However, other embodiment may simply require that a listener be able to separately perceive visual indicators 136*a* and 136*b* while positioned/located relative to each of emitters 130*a* or 130*b*, rather than requiring simultaneous perception of visual indicators 136*a* and 136*b*.

It should be further noted that, as illustrated in FIG. 8D, an offset in positioning (off of center) may be incorporated to account for the distance between a listener's ears and eyes. That is, a listener's eyes and ears are not usually located so as to both be in the line of travel of the center of the ultrasonic signal. Accordingly, this distance between the listener's eyes and ears may be taken into consideration when orienting emitters 130*a* and 130*b* relative to intended target 134. That is, in this and other embodiments, visual indicators 136*a* and 136*b* may be offset on/in emitters 130*a* and 130*b*, respectively, so that the perception of visual indicators 136*a* and 136*b* by the eyes of intended target 134 results in emitters 130*a* and 130*b* being 'aimed' towards/at the ears of intended target 134. The amount of offset configured in an emitter/visual indicator combination, can be adjustable or predetermined. Additionally, the offset can be determined/characterized in a number of ways, either by linear distance, angular offset, etc. Standardized distances based on statistical averages can be used, or they can be tailored to a listener or group of listeners.

It should be noted that the actual output of light from visual indicator 136, in the case where visual indicator 136 is a light source, such as an LED or optical fiber, for example, may be adjusted to achieve a desired concentration/narrowing of light.

In accordance with some embodiments, visual indicator 136 may be driven, at least in part, by the ultrasonic signals output by ultrasonic emitter 130. For example, the energy of the ultrasonic carrier may be used to create a bias applied to an LED, one example, of visual indicator 136. In this regard, the ultrasonic carrier may be used to power and/or switch on visual indicator 136. It should be noted that driving visual indicator 136 in this manner need not adversely affect the ultrasonic carrier, as LEDs and the like require low power, and lighting visual indicator 136 may be achieved without interfering with the overall performance of an ultrasonic sound system, as described accordance with various embodiments herein. Driving visual indicator 136 may be done continuously so long as the ultrasonic carrier is outputted. That is, visual indicator 136 may remain in a powered on state during active outputting of ultrasonic carrier signals. Alternatively, visual indicator 136 may simply flicker or experience selective powering during active ultrasonic carrier signal generation/outputting.

Figure 9:
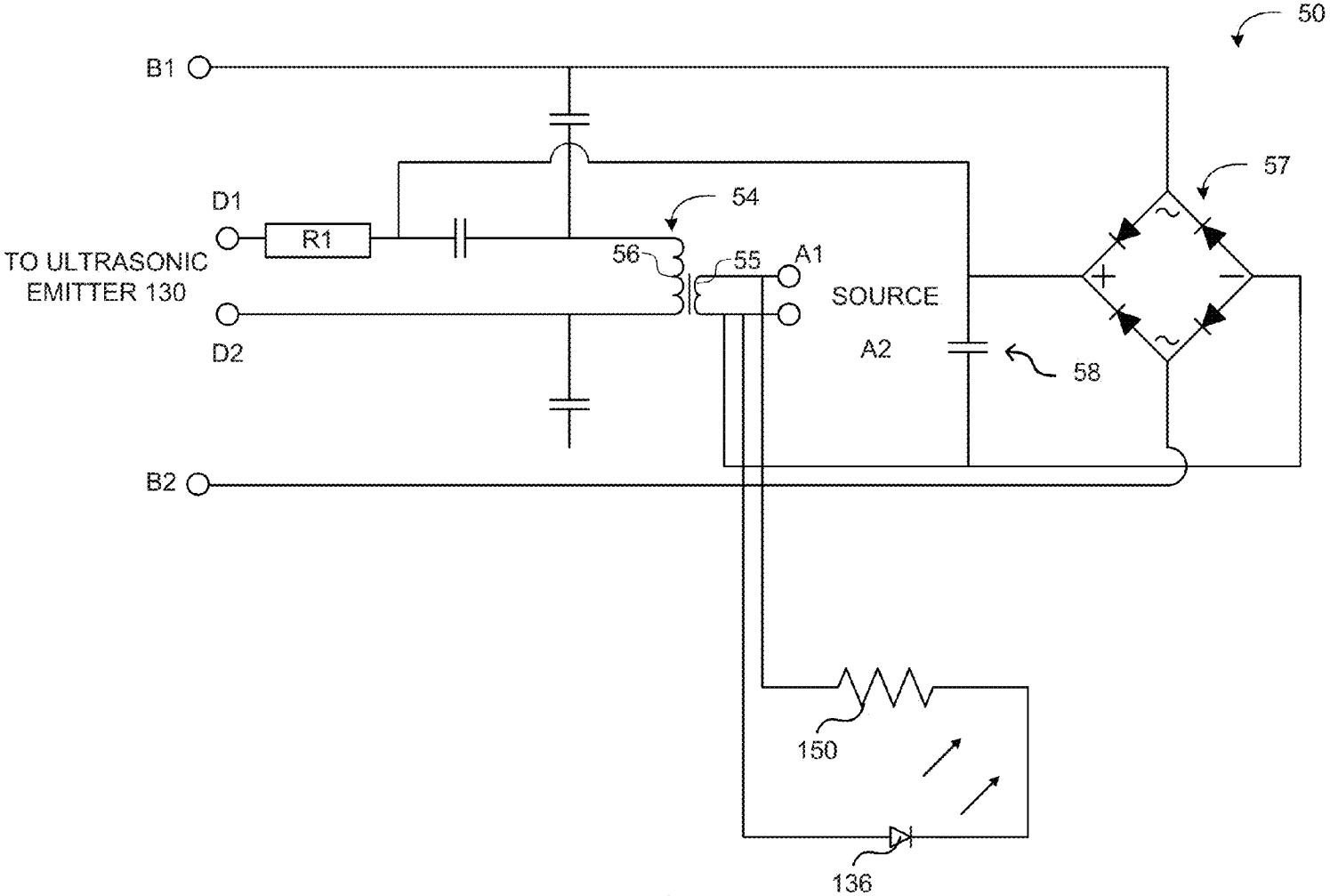
FIG. 9 is a diagram illustrating an example driving circuit used to power a visual indicator in accordance with one embodiment.

FIG. 9 illustrates an example of a driver circuit, which may be driver circuit 50 of FIG. 5, incorporating a visual indicator 136, such as an LED, which is coupled to ultrasonic emitter 130. That is, visual indicator 136 may be incorporated into driver circuit 50. In accordance with one embodiment, visual indicator 136 may be coupled to the primary windings 55 of the transformer, as shown in FIG. 9. A resistor 150 may be added between visual indicator 136 and the transformer for limiting current flowing into visual indicator 136. Resistor 150 may be a 1K ohm resistor, for example. Accordingly, the visual indicator 136 may be configured to switch on (or off) in correlation with the operation of ultrasonic emitter 130.

As described thus far, visual indicator 136 has been utilized as a mechanism for indicating to intended target 134 that it is in the appropriate position to receive transmitted audio from ultrasonic emitter 130. However, visual indicator 136 may also be utilized as a mechanism for with positioning ultrasonic emitter 130 itself in order to achieve a desired targeted audio transmission. For example, visual indicator 136 can be implemented with, e.g., a light transmission source, such as a laser, that can be projected onto or in the vicinity of an intended target, e.g., intended target 134. In this way, a user of ultrasonic emitter 130 can accurately point or position the ultrasonic emitter to transmit audio in a particular direction, path, etc.

Figure 10:
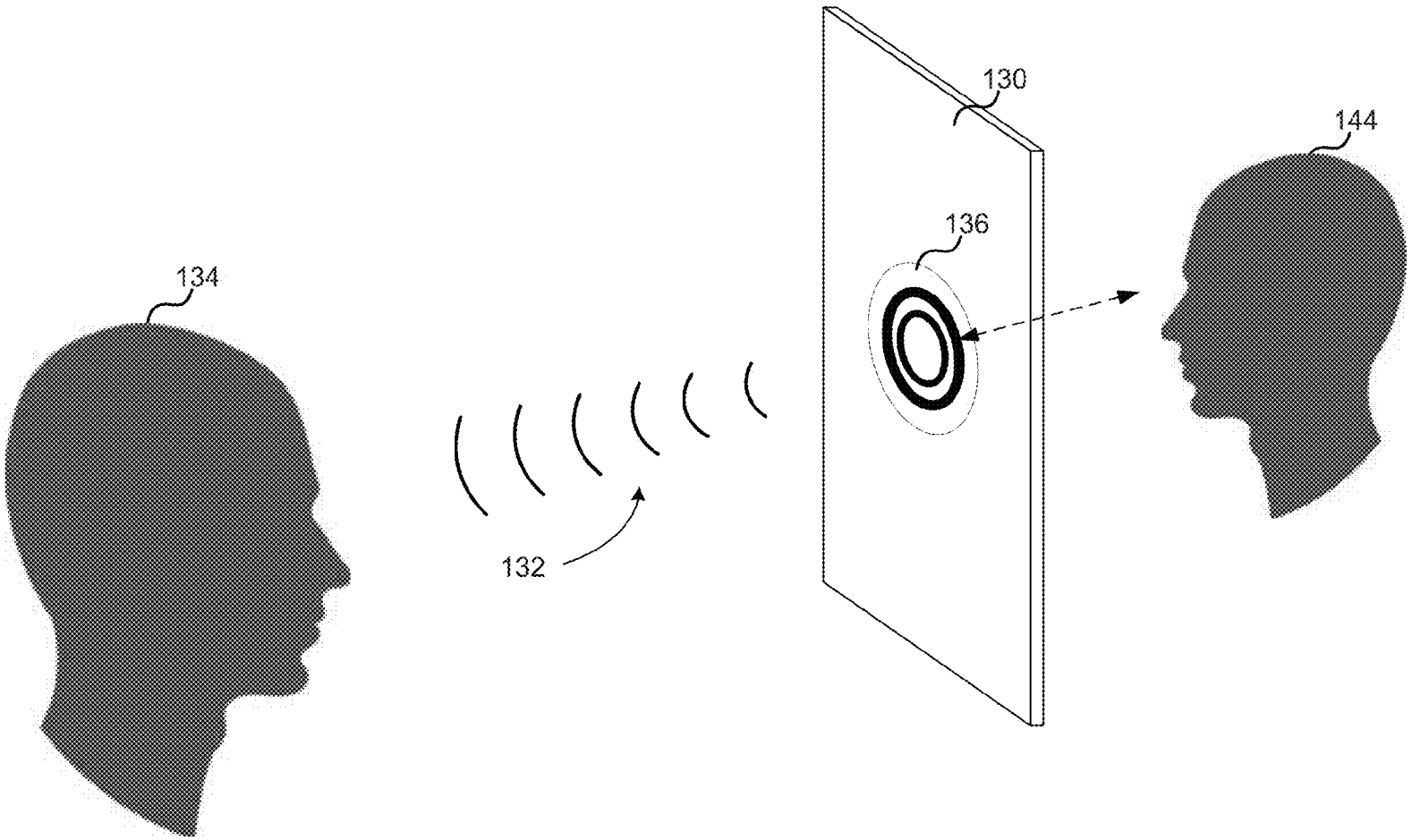
FIG. 10 is a diagram illustrating an example of an emitter in which a visual indicator configured as a sighting tool is incorporated in accordance with one embodiment.

For example, and as previously described, an ultrasonic emitter configured in accordance with various embodiments can be made of transparent materials resulting in a transparent emitter. Therefore, as an alternative to or in addition to utilizing a light transmission source such as a laser to "sight" an ultrasonic transmitter, a reflector or reflex sight may be incorporated into a transparent ultrasonic emitter. A reflex sight can refer to an optical device that allows the user to look through a partially reflecting glass element and see an illuminated projection of an aiming point, such as reticle, or some other image superimposed on the field of view. FIG. 10 illustrates an example of a transparent emitter 130 incorporating a visual indicator 136 in the form of a reflex sight. A user 144 may aim transparent emitter 130 in a desired direction, i.e., towards an intended target 134, using visual indicator 136 as a sighting tool.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. An ultrasonic audio speaker, comprising:

a backing plate;

a flexible layer disposed adjacent the backing plate, the backing plate and the flexible layer each configured to be electrically coupled to a respective one of a pair of signal lines carrying an audio modulated ultrasonic carrier signal, wherein upon application of the audio modulated ultrasonic carrier signal, the flexible layer is configured to launch a pressure-wave representation of the audio modulated ultrasonic carrier signal into the air; and a visual indicator configured to provide visual feedback indicative of an orientation of the ultrasonic audio speaker relative to a position of an intended target of the audio modulated ultrasonic carrier signal, wherein the visual indicator is capable of being perceived by an individual only when the individual is positioned in the path of the audio modulated ultrasonic carrier signal.

2. The ultrasonic audio speaker of claim 1, wherein the visual indicator comprises a plurality of markings configured such that each of the plurality of markings is capable of being perceived by an individual only when the ultrasonic audio speaker is oriented toward the individual.

3. The ultrasonic audio speaker of claim 1, wherein the visual indicator comprises a light emitting diode (LED) and a concentrator configured to narrow a viewing angle of the LED such that light emitted from the LED is capable of being perceived by an individual only when the individual is positioned in the path of the audio modulated ultrasonic carrier signal.

4. The ultrasonic audio speaker of claim 1, wherein the visual indicator comprises an optical fiber configured to transmit light from one end distal from the ultrasonic audio speaker that is capable of being perceived only when the intended target is positioned in the path of the audio modulated ultrasonic carrier signal.

5. The ultrasonic audio speaker of claim 1, wherein the visual indicator comprises:

a light source; and at least one proximity sensor operatively connected to the light source and configured to sense the position of the intended target such that when the intended target is positioned in the path of the audio modulated ultrasonic carrier signal, the light source is configured to illuminate.

6. The ultrasonic audio speaker of claim 1, wherein the visual indicator is driven by an ultrasonic carrier and an audio signal is modulated on the ultrasonic carrier to generate the audio modulated ultrasonic carrier signal.

7. The ultrasonic audio speaker of claim 6, wherein the visual indicator comprises an LED and a resistive element configured to limit current flow into the LED.

8. An ultrasonic emitter, comprising:

a first pole comprising a conductive element having a textured surface;

a second pole comprising a metalized film disposed adjacent the textured surface of the first pole, wherein upon application of an audio-modulated ultrasonic carrier signal the second pole is configured to resonate in response to an audio-modulated signal and to launch a pressure-wave representation of the audio modulated ultrasonic carrier signal into the air; and a visual indicator configured to provide visual feedback indicative of a position of an intended target of the audio modulated ultrasonic carrier signal relative to the ultrasonic emitter, wherein the visual indicator is capable of being perceived by an individual only when the individual is positioned in the path of the audio modulated ultrasonic carrier signal.

9. The ultrasonic emitter of claim 8, wherein the visual indicator comprises a plurality of markings configured such that each of the plurality of markings is capable of being perceived only when the intended target is positioned in the path of the audio modulated ultrasonic carrier signal.

10. The ultrasonic emitter of claim 8, wherein the visual indicator comprises a light emitting diode (LED) and a concentrator configured to narrow a viewing angle of the LED such that light emitted from the LED is capable of being perceived only when the intended target is positioned in the path of the audio modulated ultrasonic carrier signal.

11. The ultrasonic emitter of claim 8, wherein the visual indicator comprises an optical fiber configured to transmit light from one end distal from the ultrasonic emitter that is capable of being perceived only when the intended target is positioned in the path of the audio modulated ultrasonic carrier signal.

12. The ultrasonic emitter of claim 8, wherein the visual indicator comprises:

a light source; and at least one proximity sensor operatively connected to the light source and configured to sense the position of the intended target such that when the intended target is positioned in the path of the audio modulated ultrasonic carrier signal, the light source is configured to illuminate.

13. The ultrasonic emitter of claim 8, wherein the visual indicator is driven by an ultrasonic carrier and an audio signal is modulated on the ultrasonic carrier to generate the audio modulated ultrasonic carrier signal.

14. The ultrasonic emitter of claim 8, wherein the ultrasonic emitter is transparent.

15. The ultrasonic emitter of claim 14, wherein the visual indicator comprises a sighting element configured to allow aiming of the ultrasonic emitter towards the intended target.

16. An ultrasonic audio speaker, comprising:

a first layer having a first major surface, a second major surface and a conductive region;

a second layer disposed adjacent the first layer and having a first major surface, a second major surface and a conductive region;

an insulating region disposed between the first and second layers, wherein the second layer comprises a backing plate and the backing plate comprises a plurality of textural elements; and a visual indicator configured to provide visual feedback indicative of a position of an intended target of an audio modulated ultrasonic carrier signal relative to the ultrasonic audio speaker, wherein the visual indicator is capable of being perceived by an individual only when the individual is positioned in the path of the audio modulated ultrasonic carrier signal.

17. The ultrasonic audio speaker of claim 16, wherein the visual indicator comprises a light emitting diode (LED) and a concentrator configured to narrow a viewing angle of the LED such that light emitted from the LED is capable of being perceived only when the intended target is positioned in the path of the audio modulated ultrasonic carrier signal.

18. The ultrasonic audio speaker of claim 16, wherein the visual indicator comprises:

a light source; and at least one proximity sensor operatively connected to the light source and configured to sense the position of the intended target such that when the intended target is positioned in the path of the audio modulated ultrasonic carrier signal, the light source is configured to illuminate.

19. The ultrasonic audio speaker of claim 16, wherein the visual indicator is driven by an ultrasonic carrier and an audio signal is modulated on the ultrasonic carrier to generate the audio modulated ultrasonic carrier signal.

* * * * *